US006585153B2

(12) United States Patent
Ryan

(10) Patent No.: US 6,585,153 B2
(45) Date of Patent: Jul. 1, 2003

(54) FRESH FOLD PACKAGE

(75) Inventor: Michael Ryan, Delaware County, PA (US)

(73) Assignee: Smurfil-Stone Container Corporation Delaware Corp., Clayton, MO (US)

( * ) Notice: Subject to any disclaimer, the term of this patent is extended or adjusted under 35 U.S.C. 154(b) by 0 days.

(21) Appl. No.: 09/798,638

(22) Filed: Mar. 5, 2001

(65) Prior Publication Data

US 2001/0025877 A1 Oct. 4, 2001

Related U.S. Application Data

(63) Continuation of application No. 09/541,641, filed on Apr. 3, 2000, now Pat. No. 6,216,943.

(51) Int. Cl.[7] ..... B65D 5/56

(52) U.S. Cl. ..... 229/117.32; 53/456; 53/467; 53/491; 229/117.33; 229/117.34; 493/100

(58) Field of Search ..... 229/117.27, 117.32, 229/117.33, 117.34, 164.2; 220/FOR 173, FOR 174; 53/455, 456, 467, 491; 493/100, 114

(56) References Cited

U.S. PATENT DOCUMENTS 2,216,527 A * 10/1940 Weiss et al. ..... 229/117.34
2,292,653 A * 8/1942 Palmer
2,307,559 A * 1/1943 Angus
2,321,681 A * 6/1943 Hultin
2,500,466 A * 3/1950 Myers
2,979,247 A * 4/1961 Pellaton et al. ..... 229/117.33
3,079,060 A * 2/1963 Cherrin
3,459,357 A * 8/1969 Egger
3,836,037 A * 9/1974 Bass
4,032,060 A * 6/1977 Bergstein
4,099,665 A * 7/1978 Bergstein ..... 229/117.34
4,403,837 A * 9/1983 Nakahashi
4,638,912 A * 1/1987 Graf ..... 229/117.33
4,660,737 A * 4/1987 Green
4,679,701 A * 7/1987 Ackerman
4,872,588 A * 10/1989 Texidor ..... 229/117.34
4,948,266 A * 8/1990 Bencie
4,969,596 A * 11/1990 Schulbaum ..... 229/117.27
5,094,359 A * 3/1992 DeMars et al. ..... 229/117.32
5,275,332 A * 1/1994 Heuberger
6,216,943 B1 * 4/2001 Ryan ..... 229/117.32

* cited by examiner

*Primary Examiner*—Gary E. Elkins
(74) *Attorney, Agent, or Firm*—Paul M. Denk

(57) ABSTRACT

A gabled, gussetted resealable lined container having an outer carton with foldable closure flaps and a liner within the carton. The upper inner surfaces of the liner are releasably sealed together after filling with product and at least one of the liner upper outer edges adhered to the closure flaps on the carton, whereby when the closure flaps are opened, the inner liner is pulled opened and when the closure flaps are closed, the inner liner is resealed to maintain product freshness.

13 Claims, 5 Drawing Sheets

FRESH FOLD PACKAGE

CROSS REFERENCE TO RELATED APPLICATIONS

This is a continuation of patent application Ser. No. 09/541,641, filed Apr. 3, 2000, now U.S. Pat. No. 6,216,943, entitled Fresh Fold Package, an which is incorporated herein by reference.

BACKGROUND OF THE INVENTION

This invention relates generally to paperboard containers and more particularly to a gabled container having reclosable end closure flaps and a resealable inner bag in combination in which the container and the sealed inner bag are simultaneously opened and, when the container is closed the inner bag is resealed.

Prior art reclosable paperboard containers are known. A number of folded containers are known to the prior art which include inner liners as well. For example, U.S. Pat. No. 2,292,653, to Palmer, shows a package having an inner container. U.S. Pat. No. 2,307,559, to Angus, shows a typical combined bag and box. U.S. Pat. No. 2,321,681, to Hultin, provides for a carton with a flat top and liner assembly as does U.S. Pat. No. 3,459,357, to Egger et al. U.S. Pat. No. 4,032,060, to Bergstein, provides for a carton with a self-sealing end closure which lies within the confines of the closure and U.S. Pat. No. 4,6609,737, shows a carton and pouch system. U.S. Pat. No. 4,679,701, to Ackerman et al, does not show a carton, but an envelope-type container with an inner bag. The two lateral walls of the outer envelope have no moving parts.

None of the prior art provides for a gusseted, gabled container having fold over closure flaps which extend above the confines of the container and run the length of the gable which opens the inner line when opened and, when closed, seals the inner liner thereby offering the advantages of double sealing to keep the contents of the container fresh.

SUMMARY OF THE INVENTION

In accordance with the invention, generally stated, a gusseted, gabled resealable lined container is provided having opposing side body panels and narrower opposing end panels defining an inner chamber. The tops of the end panels each terminate in a gusset. The upper ends of side body panels are connected by the gussets so that when the gussets are folded, the upper ends of the side body panels angle inwardly forming a gable. An opposing pair of sealing flaps extend the length of the body panels forming a ridge along the gable. A liner can be positioned in the inner chamber of the container. The upper end of the inner liner, when filled and sealed, assumes a complementary gabled configuration. The upper gabled end of the sealed liner extends out of the chamber. The top sealing flaps adhere to the top of the liner so that when the sealing flaps are opened, the sealed liner is pulled open. When the container is closed, the sealing flaps are folded over one side of the gable, securing the closed liner therebetween for sealing.

BRIEF DESCRIPTION OF THE DRAWINGS

Corresponding reference numerals indicate corresponding structures throughout the various drawings.

DETAILED DESCRIPTION OF THE INVENTION

Figure 1:
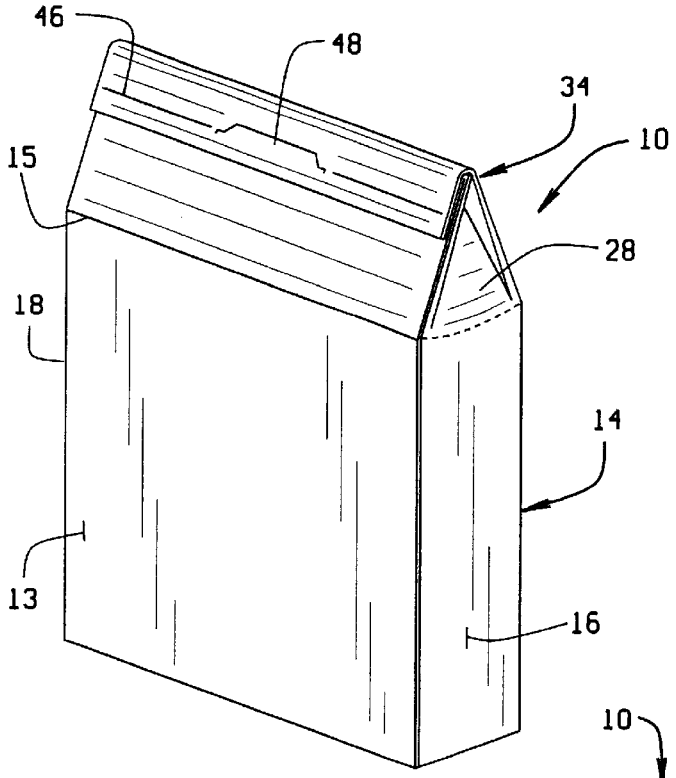
FIG. 1 is an isometric view of the gabled resealable lined container of the present invention in a closed, sealed gabled configuration.

The gabled resealable lined container of the present invention is indicated generally in the drawings by reference number 10. It will be appreciated that the container 10 is designed as a container for any number of products to maintain freshness and purity. For example, container 10 can contain food products for man or animal, such as cereals, snacks, condiments of the like. Furthermore, the container can be used for non-edible products which may be granular or powdered, such as chemicals. Hence, the ultimate contents of container 10 are not necessarily related to the scope of the invention.

Figure 2:
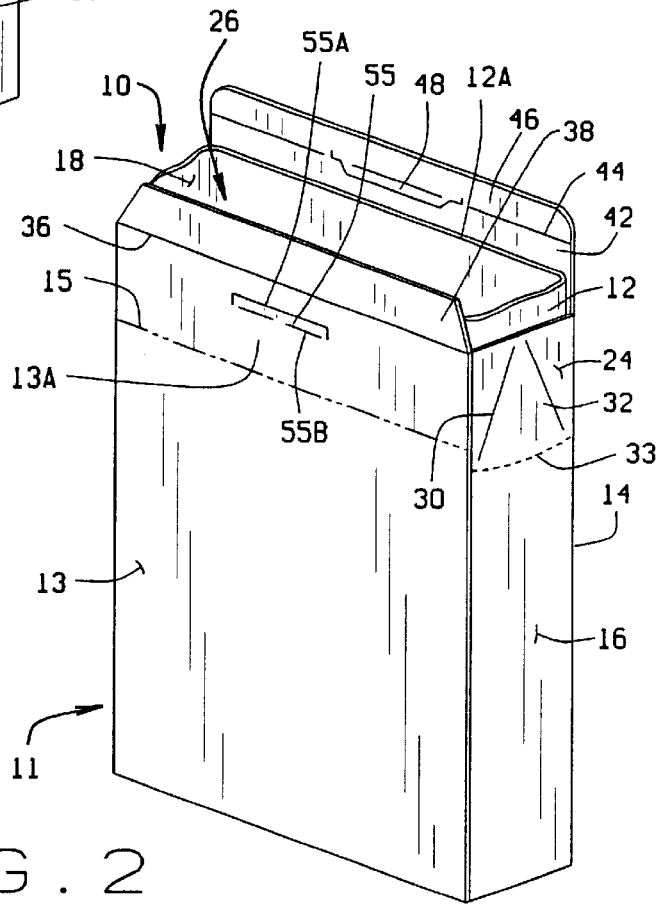
FIG. 2 is an isometric view of the gabled resealable lined container of the present invention in an open configuration.
Figure 3:
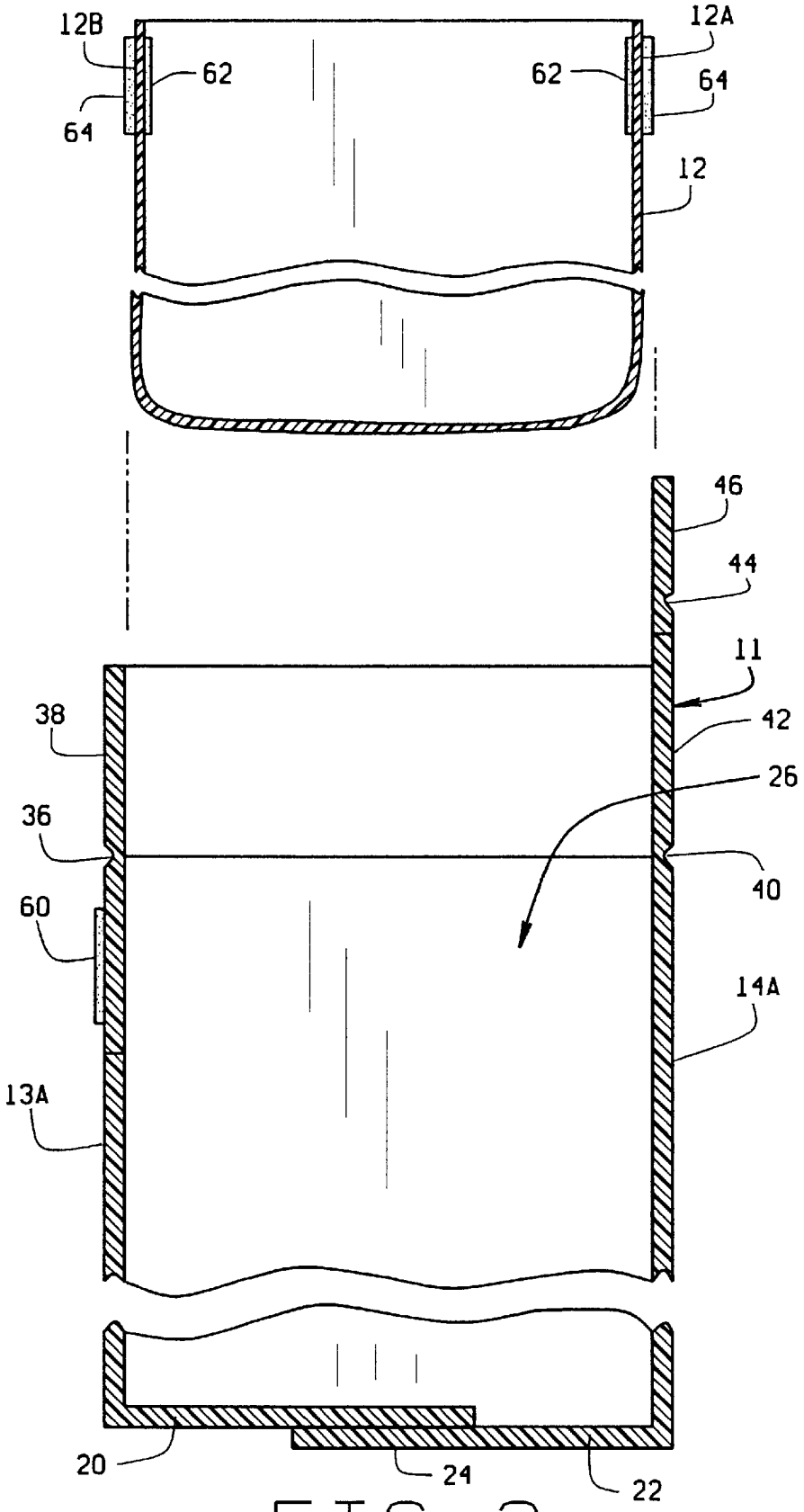
FIG. 3 is a cross-sectional, exploded view of gable resealable lined container of the present invention showing the relationship between the liner and the container carton.
Figure 4:
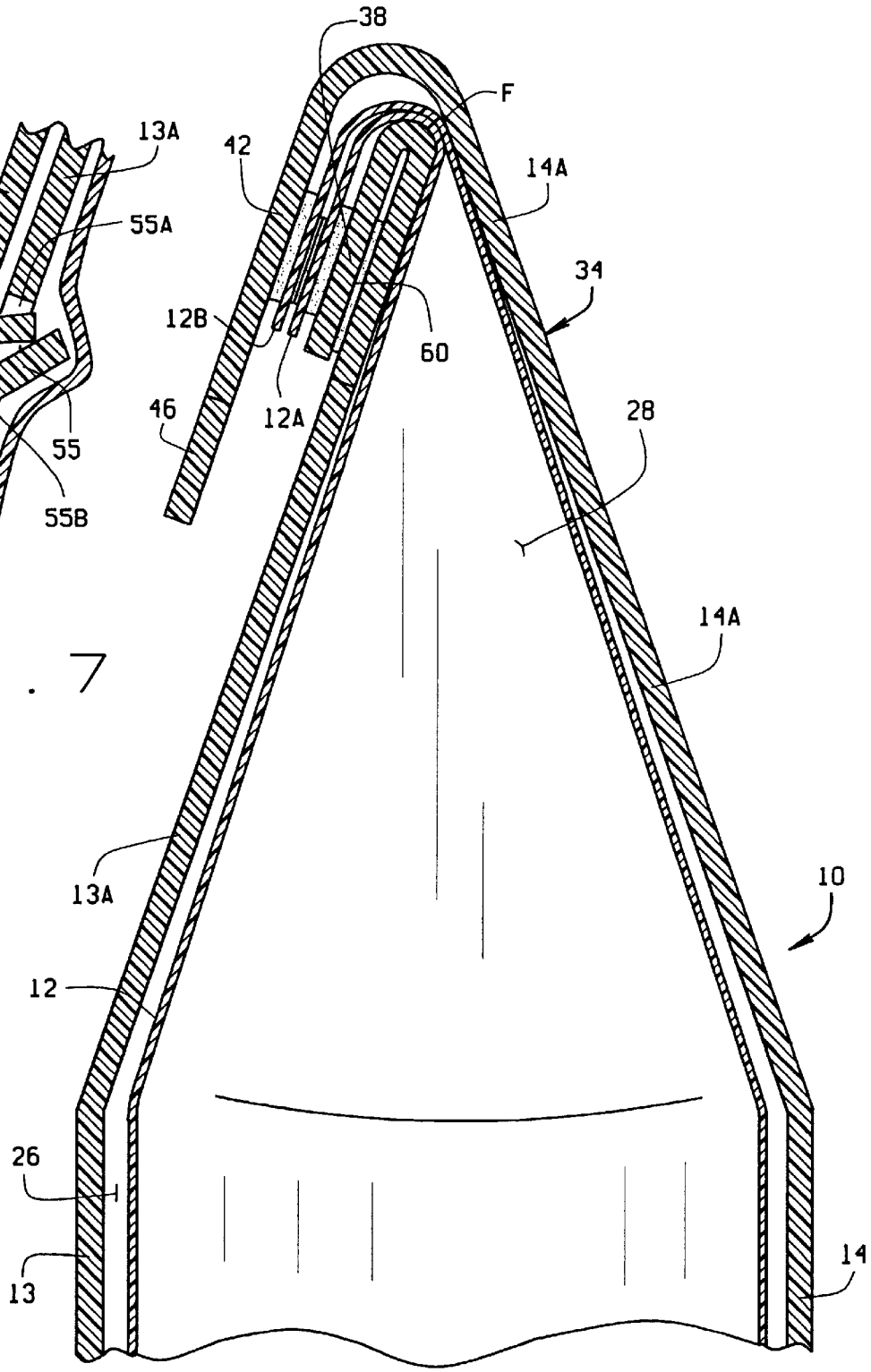
FIG. 4 is an enlarged, cross-sectional view of the access end of the gabled resealable lined container of the present invention in a closed and sealed configuration.
Figure 5:
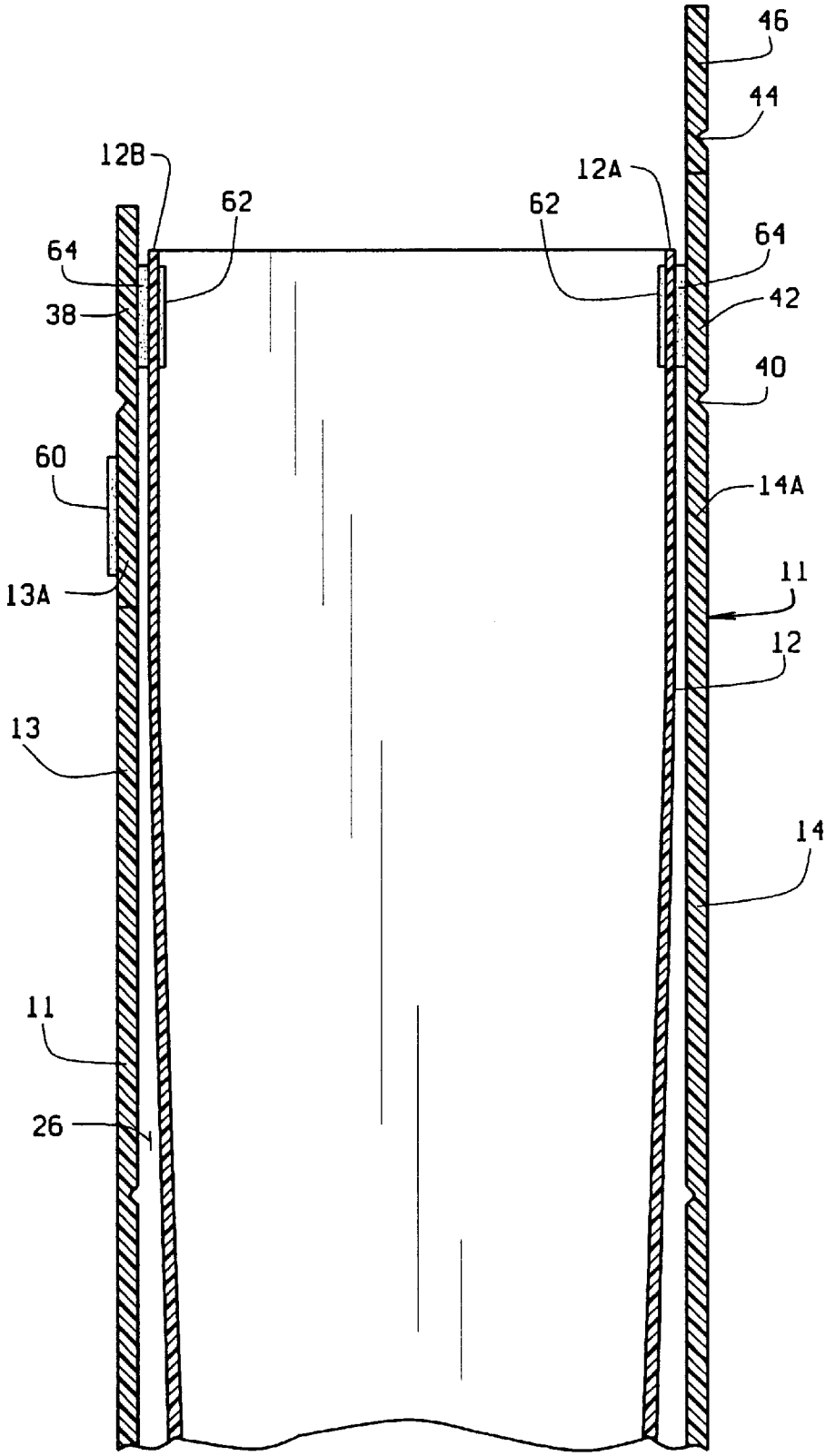
FIG. 5 is an enlarged, cross-sectional view of the access end of the gabled resealable lined container of the present invention in an opened configuration.

It will be appreciated by those skilled in the art that container 10 includes an outer semi-rigid carton 11 with an inner liner 12. The carton 11 is constructed from a folded paper board blank (not shown) which is conventionally stamped from sheet stock using a cutting die as is known to the art. Carton 10 includes first side wall 13 and a second opposed side wall 14 (FIGS. 2,4,5). The side walls 13 and 14 include fold lines 15 which allow the upper portions 13A and 14A of side walls 13 and 14 respectively, to be folded inwardly, as shown in FIG. 1 and as will be explained below. The carton 11 includes a first end wall 16 and an opposed, identical second end wall 18. It will be noted in the illustrated embodiment, the side walls 13 and 14 have a greater width than the end walls 16 and 18. However, the walls can be constructed in any acceptable dimensions. As shown in FIG. 3, first side wall 13 includes, at a lower end, a bottom wall flap 20. Second side wall 14 also includes, at a lower end, a bottom wall flap 22. The bottom wall flaps 20 and 22 are folded into an overlapping relationship and glued or appropriately secured to create a bottom wall 24. The first and second side walls 13 and 14, the end walls 16 and 18 and bottom wall 24 define an inner carton chamber 26.

As shown in FIG. 1, each end wall 16 and 18 includes, at the top edge, a gusset 28. Gusset 28 includes a first inwardly angled fold line 30 and a second inwardly angled fold line 32. The gussets 28 at the top of each end wall allow the tops of the end walls to be folded inwardly, thus drawing the top portions 13A and 14A of side walls 13 and 14 respectively, inward to form a gable 34.

Figure 7:
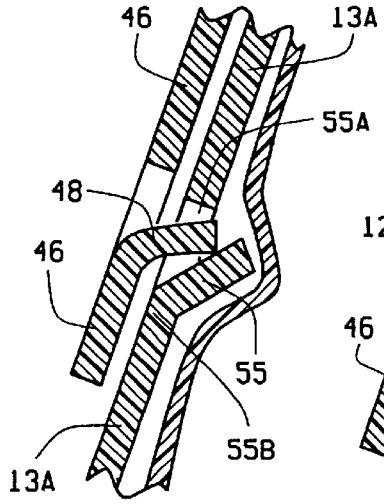
FIG. 7 is an enlarged fragmentary cross-sectional view of the locking tab feature of the closure the gabled resealable lined container of the present invention.

The upper portion 13A of side wall 13 includes a fold line 36 defining a sealing flap 38. The upper portion 14A of side wall 14 includes a fold line 40 defining a first sealing flap 42. The first sealing flap 42 includes a fold line 44 which defines a second sealing flap 46. A locking tab 48 is formed at the fold line 44. The locking tab 48 is positioned to engage a locking tab slot 55 formed in the upper segment 13A of side wall 13 when the container is in a closed and locked configuration, as shown in FIG. 1. Slot 55 is formed by a slit 55A through the paperboard and fold line 55B. The relationship between the locking tab 48 and slot 55 is shown in greater detail in FIG. 7. As can be appreciated, the locking tab 48 can be inserted into slot 55 in the engaging wall segment 13A. It will be noted that this tab-slot locking arrangement is designed to be used after the container is opened the first time to keep the container 10 closed. It will be understood that when the container is filled for the first time, by the manufacturer, the sealing flaps are adhered to the wall segment 13A with an appropriate adhesive 60, as illustrated in FIG. 4, and as will be explained below.

The tab 48 and its associated slot 55 do not form a part of this invention, and could be omitted if desired. Alternatively, some other conventional arrangement can be used to hold the container 11 closed after it has been opened by a consumer.

Figure 6:
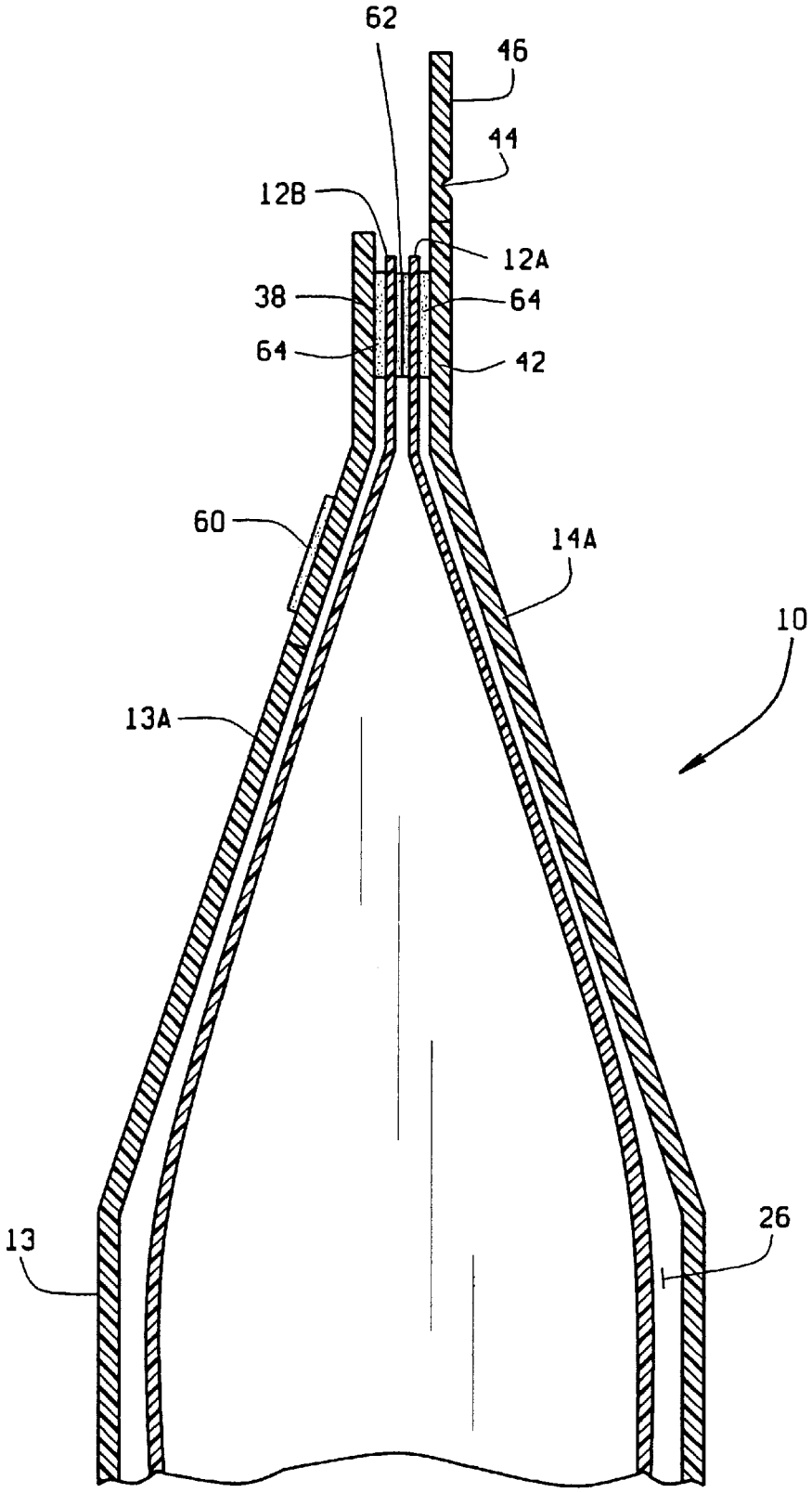
FIG. 6 is an enlarged, cross-sectional view of the access end of the gabled resealable lined container of the present invention in a closed configuration with the outer closure opened with the inner liner remaining sealed.

As stated previously, the container 10 includes an inner liner 12 made from a liner blank, as is known in the art. The inner liner 12 is a lightly sealed or an open ended bag or the like configured having contiguous side walls and a bottom to rest within chamber 26. It will be appreciated that the liner 12 is constructed from a durable, moisture and air resistant material such as waxed paper, cellophane, foil or any appropriate material. During production of the container the liner 12 is filled with desired contents. The inner surfaces of upper edges 12A and 12B (FIG. 5) then are sealed together, if it is an opened liner, as shown in FIG. 6 by a light adhesive 62. The adhesive 62 can be omitted if desired. If used, the adhesive 62 can be any appropriate adhesive that will secure the upper edges to the liner together yet will retain a "tackiness" or adhesive property after the liner edges are pulled apart. The filled liner 12 is inserted into chamber 26. The gussets 28 are collapsed inwardly drawing the upper segments 13A and 14A of the side walls into the gabled configuration. The sealing flap 38 and sealing flap 42 are adhered to the liner outer surfaces 12A and 12B, respectively, with an adhesive 64. (FIG. 6). The adhesive 64 is stronger than the adhesive 62. As illustrated in FIG. 3, the adhesive 64 is designed to have greater adhesive strength than the adhesive 62. The various sealing flaps are folded over, as shown in FIG. 4, and sealing flap 38 is adhered to upper side wall segment 13A. Due to the presence of adhesives 60, 62 and 64 the container 10 is sealed in a closed configuration for shipment and storage.

In use, the consumer can grasp flap 46 and pull seal flap 38 away from adhesive 60 and move the various sealing flaps into an upright or rigid configuration as shown in FIG. 6. The user can then grasp flaps 38 and 46 and exert an outward pressure to break the seal between upper liner edges 12A and 12B. Since the adhesive strength of adhesive 64 is greater than that of adhesive 62, the liner upper edges 12A and 12B will remain adhered to flaps 38 and 42, respectively, and allow the liner to be pulled open for access to the contents as shown in FIG. 5.

To close the container 10 after access and use, the gussets 28 are collapsed and the gable 34 is formed. Because adhesive 62 retains its adhesive properties, the upper edges of the liner 12 are resealed. Thus, if the adhesive 62 is used, the liner 12 will be sealed independently of the carton 11. The various sealing flaps are folded into their closed position (FIG. 4). The upper edges 12A and 12B of the liner 12 are sandwiched between flaps 38 and 42. Moreover, the liner is pinched at the flap fold area F (FIG. 4) to more completely seal the liner, resulting in a closed container that retains the freshness of its contents by forming relatively air impervious seals between the liner edges 12A and 12B, as well as at fold area F. When closed after the first use, the various flaps are secured in their folded and sealed arrangement by inserting tab 48 into slot 55.

It will be appreciated by those skilled in the art, various changes and modifications may be made in the container of the present invention without departing from the scope of the appended claims. Therefore, the foregoing description and accompanying drawings are intended to be illustrative only and should not be construed in a limiting sense. For example, the container can be formed by first forming the carton 11, then inserting the liner 12 and adhering the liner upper edges 12A and 12B to the sealing flaps 38 and 42, respectively. In this instance, the liner 12 can be pre-filled, or the container (with the liner 12 in the carton 11) can be filled subsequently. Alternatively, the manufacturing process could begin with a carton blank and a liner blank which are adhered together. The carton/liner would then be side seam glued, and the bottom panels folded and glued, leaving an opened top, lined carton. Then the outer edges of the liner top would be adhered to one or both of the sealing flaps 38 and 42, if this was not done previously. Then, as above, the flaps would be folded over, with the liner trapped between them, and the extended flap of open outer carton wall would be adhered to the other carton wall. If desired, the third sealing flap 46 (which extends from the sealing flap 42) could be omitted. In this instance, alternative means, such as bendable tabs, could be used to maintain the sealing flaps 38 and 42 folded in a closed position. These examples are merely illustrative.

What is claimed is:

1. A gabled resealable container comprising:

a pair of opposed side panels; a pair of opposed end panels, and a bottom panel; said side panels, end panels, and bottom panel defining an inner chamber;

a pair of opposed top sealing flaps, one each of said sealing flaps positioned along the transverse length of and extending above a top edge of each of said side panels;

a gusset fold at the top of each end panel, each said gusset being connected to the top of each of said opposed side panels whereby when said gussets are in a folded position said side panels are folded inward forming a gable;

a liner within said chamber, said liner having a first wall and a second wall; each said liner wall having an upper edge, the liner walls being releasably affixed to each other when the container is in a closed configuration.

2. The gabled resealable lined container of claim 1 wherein the upper edge of at least one of said first and second liner walls is affixed to one of the top sealing flaps.

3. The gabled resealable lined container of claim 1 wherein one of each said upper edges of said first and second liner walls is affixed to one each of the top sealing flaps.

4. A resealable container comprising:

an outer carton, said carton including a first side panel and a second side panel, a first end panel and a second end panel, and a bottom panel; said respective panels defining an inner chamber;

a first sealing flap extending transversely along an upper edge of said first side panel;

a second sealing flap extending transversely along an upper edge of said second side panel;

a liner positioned within said chamber, said liner having a first upper edge and a second upper edge, said first liner upper edge being adhered to one of said first and second sealing flaps, said first and second upper edges of said liner being releasably adhered to each other when the container is in a closed position.

5. The resealable container of claim 4 wherein said liner second upper edge is adhered to the other of said first and second sealing flaps.

6. The resealable container of claim 4 including a third sealing flap extending transversely along an upper edge of said second sealing flap.

7. A process for constructing a resealable lined container comprising:

(a) providing a blank from which an outer carton is formed; said outer carton blank including a first side panel, a second side panel, a first end panel, a second end panel and a bottom panel, said respective panels capable of being folded to define an inner chamber; said first side panel including a first sealing flap along an upper edge thereof, said second side panel including a second sealing flap along an upper edge thereof;

(b) providing an inner liner having a first and second wall and each wall having an upper edge, the upper edges of said liner defining an opening;

(c) releasably adhering an inner surface of the upper edge of the first liner wall to an inner surface of the upper edge of the second liner wall;

(d) adhering an outer surface of said first liner wall upper edge to one of said first and second sealing flaps;

(e) folding said first sealing flap and said second sealing flap, with the upper edges of the first and second liner walls therebetween, onto said first wall panel.

8. The process of claim 7 wherein the process includes a step of adhering the liner second upper edge to the other of said first and second sealing flaps.

9. The process of claim 7 wherein said outer carton includes a third sealing flap extending from said second sealing flap; said method including securing said third sealing flap to said first wall panel thereby securing said carton and liner in a sealed closed position.

10. The process of claim 7 including a step of forming the liner prior to positioning liner into the carton chamber.

11. The process of claim 10 including placing the contents of the container into said liner prior to placing said liner in said carton.

12. The process of claim 7 wherein said first end panel includes a first gusset at an upper edge thereof and said second end panel includes a second gusset at an upper edge thereof; said process including a step of collapsing said first and second gussets thereby folding said first and second wall panels inwardly to form a gable.

13. The process of claim 7 wherein the liner is adhered to the blank prior to folding the blank into a carton.

* * * * *

UNITED STATES PATENT AND TRADEMARK OFFICE

CERTIFICATE OF CORRECTION

PATENT NO. : 6,585,153 B2
DATED : July 1, 2003
INVENTOR(S) : Michael Ryan

It is certified that error appears in the above-identified patent and that said Letters Patent is hereby corrected as shown below:

Title page,
Item [73], Assignee, reads "Smurfil-Stone Container Corporation" should read
-- Smurfit-Stone Container Corporation --

Signed and Sealed this

Twenty-third Day of December, 2003

JAMES E. ROGAN
*Director of the United States Patent and Trademark Office*